US005294306A

United States Patent [19]

Howard et al.

[11] Patent Number: 5,294,306

[45] Date of Patent: Mar. 15, 1994

[54] ELECTROLYTIC REMOVAL OF MAGNESIUM FROM MOLTEN ALUMINUM

[75] Inventors: Norman E. Howard, Harbor Beach; Basant L. Tiwari, Sterling Heights, both of Mich.

[73] Assignee: General Motors Corporation, Detroit, Mich.

[21] Appl. No.: 980,049

[22] Filed: Nov. 23, 1992

[51] Int. Cl.[5] ..... C25C 3/04; C25C 3/20; C25C 3/08

[52] U.S. Cl. ..... 204/70; 204/67; 204/225; 204/245

[58] Field of Search ..... 204/67, 70, 243 R-247, 204/140, 225

[56] References Cited

U.S. PATENT DOCUMENTS

| | | | |
|---|---|---|---|
| 4,045,309 | 8/1977 | Andersen | 204/225 X |
| 4,183,745 | 1/1980 | Tsumura | 204/70 X |
| 4,298,437 | 11/1981 | Hard | 204/70 |
| 4,414,070 | 11/1983 | Spence | 204/225 |
| 4,430,174 | 2/1984 | Tsumura | 204/67 |
| 4,468,300 | 8/1984 | Byrne et al. | 204/70 X |
| 4,500,401 | 2/1985 | Clark et al. | 204/225 |
| 4,504,366 | 3/1985 | Jarrett et al. | 204/1 R |
| 4,504,369 | 3/1985 | Keller | 204/70 X |
| 4,540,474 | 9/1985 | Voegel | 204/67 |
| 4,670,110 | 6/1987 | Withers et al. | 204/67 |
| 4,816,129 | 3/1989 | Sandvik | 204/243 R |
| 4,973,390 | 11/1990 | Christini et al. | 204/68 |

OTHER PUBLICATIONS

B. L. Tiwari, "Demagging Processes for Aluminum Alloy Scrap," Journal of Metals, vol. 34, No. 7, p. 54, 1982.

B. L. Tiwari et al., "Electrolytic Extraction of Magnesium from Commercial Aluminum Alloy Scrap-" Physical Chemistry of Extractive Metallurgy, The Metallurgical Society of AIME, p. 147, 1985.

B. L. Tiwari et al., "Electrolytic Demagging of Secondary Aluminum in a Prototype Furnace," AFS Trans., vol. 94, p. 385, 1986.

B. L. Tiwari et al., "Electrolytic Removal of Magnesium from Scrap Aluminum," Journal of Metals, Jul. 1984, pp. 41-43.

*Primary Examiner*—Donald R. Valentine

*Attorney, Agent, or Firm*—Lawrence B. Plant

[57] ABSTRACT

Method and apparatus for controlling the temperature of a molten salt, electrolytic demagging cell wherein an operating condition of the cell (e.g., current, temperature, etc.) is measured and a cathode immersed in the cell's electrolyte is moved to and fro the aluminum melt in the cell in response to the measured condition to vary the heat input to the cell.

13 Claims, 1 Drawing Sheet

ELECTROLYTIC REMOVAL OF MAGNESIUM FROM MOLTEN ALUMINUM

This invention relates to a method and apparatus for electrolytically removing magnesium from molten aluminum (i.e., demagging), and more particularly to controlling the temperature of a molten salt, electrolytic demagging cell by controlling the extent of the interelectrode gap during the course of the process.

Many aluminum die casters use secondary aluminum which often has undesirably high levels of magnesium therein which can be deleterious to castings made therefrom. It is well known to electrolytically remove the magnesium from molten aluminum. In this regard, a three layer electrolytic cell is provided wherein Mg-contaminated aluminum forms the lowermost layer and the cell's anode, a layer of molten salt electrolyte floats atop the aluminum and a layer of magnesium floats atop the salt and serves as the cell's cathode. Electrolyzing current is passed through the aluminum, salt and the magnesium to electrolytically scavenge magnesium from the aluminum and deposit it in the topmost layer. The rate of magnesium removed is a direct function of the current flow. Similarly, the heat energy put into the cell is a function of the square of the current flow (i.e., $I^2R$). The molten salt typically comprises a mixture of magnesium chloride, calcium chloride, sodium chloride and potassium chloride and may or may not include an alkali metal fluoride. The three layers remain physically separated due to differences in their densities. The gap between the anode (i.e., Al layer) and the cathode (i.e., the Mg layer) is fixed by the amount of salt present, but is not uniform within the cell due to doming of the aluminum resulting from the shape of the magnetic field induced into the cell.

It has now been determined that the operational efficiency of the cell is most effective in a relatively narrow operating temperature range (i.e., about 20°-30° C.), and that the size of the interelectrode gap is extremely important in controlling the heat balance, within the cell. In this regard, the size of the interelectrode gap affects the amount of heat generated in the electrolyte, as well as the current distribution in the cell which in turn affects the magnetic fields created in the cell. Since the molten salt electrolyte is the primary source of most of the electrical resistance in the cell, the present invention focuses on controlling the amount of heat produced in the cell, as well as the local current distribution, by varying the size of the interelectrode gap during operation of the demagging cell.

For smooth, efficient operation of a cell, precise control of the interelectrode gap is necessary. In the aforesaid conventional demag cell, the magnesium layer is the cathode and, as a result, the interelectrode gap is fixed, and cannot be easily varied without adding or removing electrolyte from the cell. Therefore, a cell of this type is normally designed for a given electrolyte depth/thickness and cell current in order to maintain an optimum operating temperature. Since the depth of the electrolyte layer in such cells is kept constant, there is no ready flexibility in changing the current distribution and/or cell current without affecting the cell temperature. It would be desirable to be able to simply modulate cell temperature and electrolyzing current in order to provide better control over the operation of the cell.

Accordingly, it is an object of the present invention to provide an electrolytic aluminum demagging cell including a non-consumable cathode submerged in the electrolyte and movable therein with respect to the aluminum-electrolyte interface during the course of cell operation to modulate the cell's temperature. It is a further object of the present invention to provide a process for operating an electrolytic demagging cell including the principle step of varying the gap between a non-consumable cathode immersed in the electrolyte and the aluminum-electrolyte interface in a controlled manner responsive to the cell's operating conditions to modulate the cell's operating temperature. These and other objects and advantages of the present invention will become more readily apparent from the description thereof which follows.

BRIEF DESCRIPTION OF THE INVENTION

In one aspect, the invention contemplates an electrolytic demagging cell comprising: (1) a vessel for containing a Mg-contaminated aluminum, a molten salt electrolyte floating atop the aluminum and molten magnesium floating atop the electrolyte; (2) a non-consumable cathode submerged in the electrolyte and spaced from the interface between the electrolyte and the aluminum; (3) means for passing electrolyzing current through the aluminum, electrolyte and cathode so as to deposit magnesium on the surface of the cathode; and (4) elevator means connected to the cathode for moving the cathode up and down within the molten salt electrolyte so as to vary the gap between the cathode and the electrolyte-aluminum interface as a means for modulating the temperature of the cell and/or electrolyzing current passing through the cell. In a preferred embodiment of the invention, the cell will also include a sensor for sensing a particular cell operating condition (e.g., temperature and/or current), and means responsive to the sensor output to control the elevator and automatically position the cathode relative to the aluminum-electrolyte interface. In a most preferred embodiment, the sensor comprises a thermometer (e.g., thermocouple) for monitoring the temperature of the aluminum in the immediate vicinity of the interface between the aluminum and the electrolyte. In another aspect, the invention contemplates a method of controlling the temperature and/or electrolyzing current in an electrolytic demagging cell by monitoring a cell operating condition (e.g., temperature) and, in response thereto, varying the size of the interelectrode gap to modulate cell temperature and/or current.

DETAILED DESCRIPTION OF A SPECIFIC EMBODIMENT OF THE INVENTION

Figure 2:
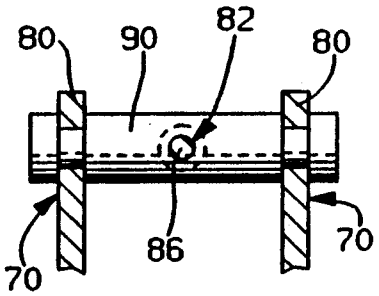
Figure 1:
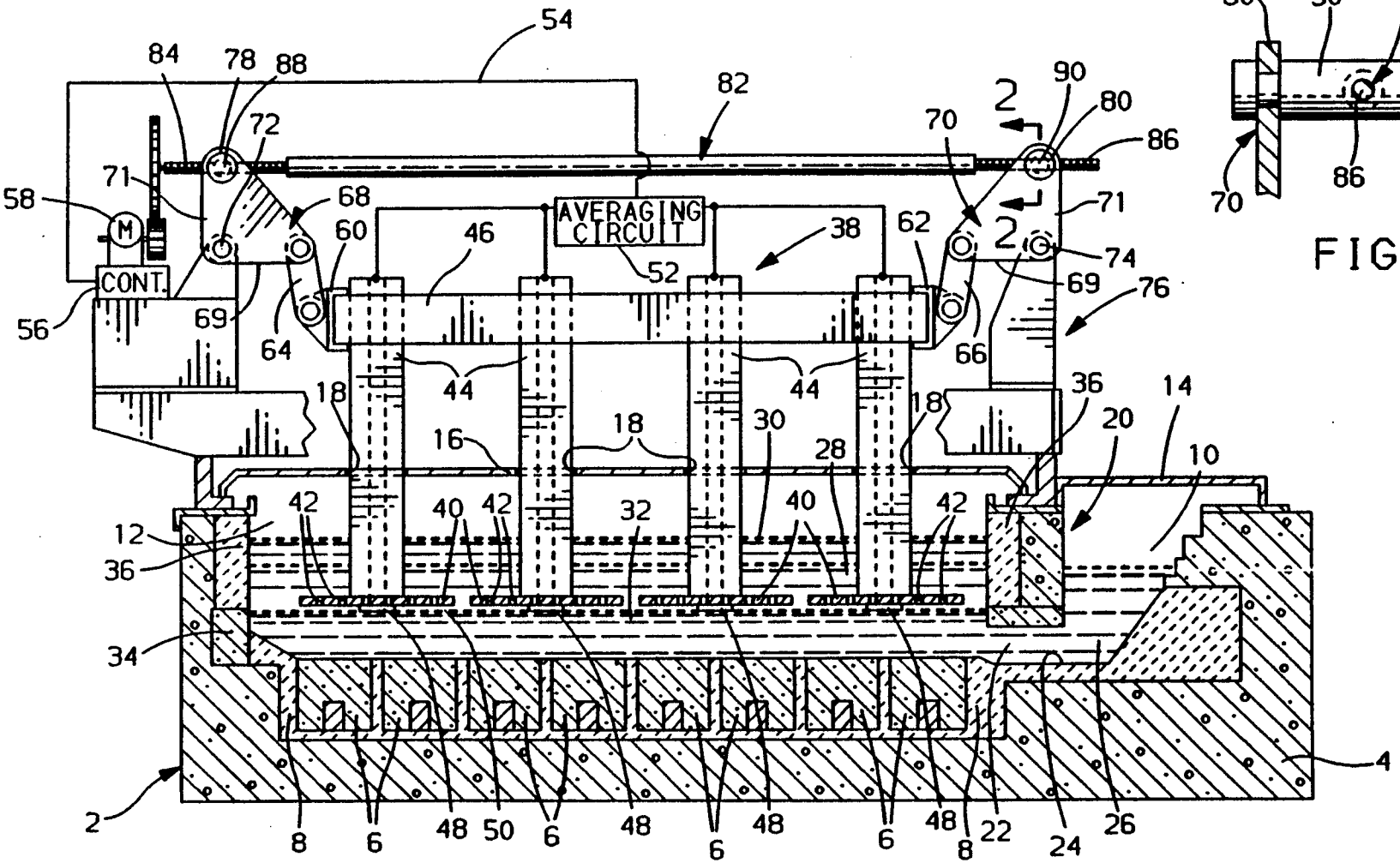

The invention will better be understood when considered in the light of the following detailed description of a specific embodiment thereof which is given hereafter in conjunction with the Figures wherein:

FIG. 1 is a partially sectioned side elevational view of an electrolytic demagging cell in accordance with the present invention; and FIG. 2 is a view in the direction 2—2 of FIG. 1.

FIG. 1 depicts a heated vessel 2 comprising an outer shell 4 formed from appropriate heat resistant materials such as firebrick and clay. The vessel 2 is divided essentially into two regions including an inlet region 10 and an electrolysis region 12. The floor 4 of the electrolysis region 12 is lined with a bank of graphite anodes 6 held in place in the bottom of the vessel 2 by a graphite tamping mix 8. A first cover 14 covers the inlet region 10 while a second cover 16, having openings 18 therein, covers the electrolysis region 12. A partition, generally shown at 20, separates the inlet region 10 from the electrolysis region 12, but permits flow communication therebetween through the tap hole 22 between the underside of the partition 20 and the floor portion 24 of the vessel 2. The vessel 2 is charged with molten aluminum 26 through the inlet region 10, and is covered with molten salt electrolyte 28 in the electrolyzing region 12. After the electrolysis process has progressed for awhile, molten magnesium 30 floats to the top of the salt layer. The interface 32 between the molten aluminum 26 and molten salt 28 is confined to the electrolysis region 12. A ring of graphite 34 forms the lower portion of the wall of the electrolyzing region 12 in the region of the salt-aluminum interface 32, while a ring of fused alumina 36 forms the upper wall portion of the electrolyzing region 12 and contacts both the molten salt and magnesium.

A cathode structure, generally shown as 38, includes a plurality of individual cathode plates 40 on the lower ends of conductive bars 44 which, in turn, are mechanically and electrically coupled together via buss bar 46 such that all of the individual cathodes 40 can move in unison as will be discussed in more detailed hereinafter. Each cathode plate 40 has a plurality of perforations 42 therein to facilitate the release of molten magnesium deposited on the undersurface thereof and to reduce the drag on the cathodes as they are moved up and down through the molten salt 28.

The cell is provided with thermometer means (e.g., thermocouple, thermistor, etc.) for measuring the cells temperature. Preferably, the thermometer means are thermocouples 48 provided in the ends of one or more of the cathodes 40 so as to extend into the aluminum and sense the temperature thereof in the vicinity of the gap 50 between the cathode 40 and the aluminum-salt interface 32. While the thermometer may be used to measure the salt temperature, it is preferably used to measure the aluminum temperature which, due to its higher thermal conductivity, more quickly responds to temperature changes. Where more than one thermocouple 48 is used, the output signals therefrom are averaged by an appropriate averaging circuit device 52 and an output signal 54 therefrom is sent to the motor controller 56 for energizing the drive motor 58 for raising or lowering the cathodes 40, and hence repositioning them with respect to the salt-aluminum interface 32, as will be discussed in more detail hereinafter.

The bar 46 which couples the several cathode supporting bars 44 together is connected at its ends 60 and 62 by links 64 and 66 to triangular bellcrank levers 68 and 70 respectfully, each having first arms 69 connected to the cathodes and second arms 71 connected to an actuator for moving the bellcrank actuators. The bellcrank levers 68 and 70 pivot about posts 72 and 74 respectfully which are anchored to a support structure overlying the vessel 2 and generally shown at 76. The other ends 78 and 80 of the bellcrank levers 68 and 70 engage a screw-type actuator 82 having opposite turning threads 84 and 86 at opposite ends thereof which in turn engage internally threaded collars 88 and 90 which move axially along the screw as the screw turns and such as to move the ends 78 and 80 of the second arms 71 of the bellcrank 68 and 70 either together or further apart, and thusly either lower or raise the cathodes 40 via the first bellcrank arms 69. The cathode positioning mechanism described is particularly reliable, and accurate even in this extremely hot environment where other possible mechanisms would not survive or accurately function. In this regard, and unlike other metallurgical furnaces which are designed to contain heat, the demag furnace of the present invention is designed to dissipate heat at a very high rate to optimize productivity. As a result, the furnace surface and the surrounding temperature is much higher than encountered in, for example, aluminum refining cells. Hence cell-top temperatures as high as about 430° C. are expected (i.e., compared to about 120°-175° C. for other furnaces). Traditional elevator mechanism are typically limited to temperatures below about 190° C.

The process of the present invention may be carried out either manually by an operator, or preferably automatically. The cell is designed for variable current and anode-cathode spacing in order to accommodate different magnesium concentrations in the aluminum from one batch of aluminum to the next. The cell will operate in a substantially continuous batch mode within a narrow temperature range (preferably about 715°-735° C.), and is filled/emptied about every half hour or so depending upon the initial magnesium concentration in the aluminum and the desired residual amount to be retained after demagging. The cell temperature is controlled by adjusting the cell current, Mg concentration in the aluminum feed, and varying the internal resistance of the cell by continuously controlling the anode-cathode spacing in accordance with the present invention. During the course of a demagging cycle (i.e., about one half hour), the anode-cathode distance will be varied from one (1) to about ten (10) inches depending on the temperature of the aluminum. In accordance with the present invention, the cathode moves down and up (i.e., to and fro the Al-salt interface) to control the cell temperature in the desired operating range. Control of the cell temperature is preferably accomplished by monitoring the temperature of the aluminum in the vicinity of the cathode-anode gap, or alternatively by monitoring the electrolyzing current and moving the cathodes in response thereto. In this regard, as the gap between the cathode and anode narrows, the cell's resistance is reduced and the current flow increased. Likewise, as the cathode-anode gap increases, so too does the resistance and the current flow decreases. $I^2R$ heating occurs in the interelectrode gap. By comparing the current flow to known values at corresponding temperatures, it is possible to monitor the temperature of the bath and set the cathode-anode gap to maintain the appropriate temperature.

The cathodes may be moved manually by an operator who monitors the cell temperature and/or electrolyzing current flow. Preferably the cathodes will be moved automatically. In this latter regard, sensor measure the cell temperature and feed the results thereof into a programmable load controller 58, and the motor driving the elevator means responds directly to the output signal from such controller.

While the invention has been disclosed primarily in terms of specific embodiments thereof, it is not intended to be limited thereto, but rather only to the extent set forth hereafter in the claims which follow.

The embodiments of the invention in which an exclusive property or privilege is claimed are defined as follows:

1. In a cell for the electrolytic removal of magnesium from molten aluminum comprising essentially a vessel having a floor for containing molten Mg-contaminated aluminum and a molten salt electrolyte floating atop the aluminum with an interface therebetween, a cathode spaced from said floor, and means for passing electrolyzing current through said aluminum, electrolyte and cathode to electrolytically scavenge said magnesium from said aluminum and deposit it onto said cathode, the improvement comprising said cathode being a non-consumable electrode adapted for submersion in said electrolyte, and an elevator connected to said cathode for displacing said cathode relative to said floor to vary the distance between said cathode and said interface so as to modulate the temperature of the cell.

2. A cell according to claim 1 wherein said cathode comprises a perforate plate adapted to lie in a plane substantially parallel to said interface when said cell is filled with said molten aluminum and electrolyte.

3. A cell according to claim 1 wherein said cathode comprises a plurality of discrete electrode segments, coupling means joining said segments together and to said elevator means for movement in unison one with the other, and said elevator means includes a pair of bell crank levers each having first and second arms, said first arms being connected to said coupling means and said second arms being connected to an actuator means for moving said second arms relatively to and fro each other so as to vertically displace said cathode, and drive means for energizing said actuator means.

4. A cell according to claim 3 wherein said actuator means is a rotating screw which engages said second arms via threaded collars which move axially along said screw in opposite directions as said screw rotates and about which said second arms pivot.

5. A cell according to claim 3 wherein said first arms are connected to said coupling means via links which are pivot on said arms and said coupling.

6. In a cell for the electrolytic removal of magnesium from molten aluminum comprising essentially a vessel having a floor for containing molten Mg-contaminated aluminum and a molten salt electrolyte floating atop the aluminum with an interface therebetween, a cathode spaced from said floor, and means for passing electrolyzing current through said aluminum, electrolyte and cathode to electrolytically scavenge said magnesium from said aluminum and deposit it onto said cathode, the improvement comprising said cathode being a non-consumable electrode adapted for submersion in said electrolyte, a sensor for sensing an operating condition of the cell, and an elevator responsive to said sensor for automatically displacing said cathode relative to said floor to vary the distance between said cathode and said interface so as to modulate the temperature of the cell.

7. A cell according to claim 6 wherein said operating condition is temperature and said sensor means is a thermometer.

8. A cell according to claim 7 wherein said thermometer comprises a thermocouple adapted for immersion in said aluminum and measuring the temperature of said aluminum adjacent said interface.

9. A cell according to claim 7 wherein said thermometer is carried by said cathode and measures said temperature in the vicinity of said gap.

10. A cell according to claim 6 wherein said sensor is a current sensor sensing said electrolyzing current.

11. A method for controlling the temperature of an aluminum demagging cell having a layer of molten salt electrolyte floating atop a layer of molten Mg-contaminated aluminum comprising the steps of:

positioning a non-consumable cathode in said electrolyte spaced from the interface between said aluminum and said salt by an interelectrode gap;

passing sufficient electrolyzing current through said aluminum, electrolyte and cathode to scavenge said magnesium from said aluminum and deposit it on said cathode;

measuring an operating condition of the cell; and moving said cathode to and fro with respect to said interface in response to said measured condition to add more or less heat energy to said cell so as to maintain said cell in an optimal temperature range.

12. A method according to claim 11 wherein said opera condition is cell temperature.

13. A method according to claim 12 wherein said operating condition is said electrolyzing current.

* * * * *